US007398609B2

(12) United States Patent
Labonté

(10) Patent No.: US 7,398,609 B2
(45) Date of Patent: Jul. 15, 2008

(54) SKATE BOOT

(75) Inventor: Ivan Labonté, Montreal (CA)

(73) Assignee: Nike Bauer Hockey U.S.A., Inc., Greenland, NH (US)

( * ) Notice: Subject to any disclaimer, the term of this patent is extended or adjusted under 35 U.S.C. 154(b) by 481 days.

(21) Appl. No.: 11/117,413

(22) Filed: Apr. 29, 2005

(65) Prior Publication Data

US 2006/0179686 A1 Aug. 17, 2006

Related U.S. Application Data

(63) Continuation-in-part of application No. 11/057,766, filed on Feb. 15, 2005, which is a continuation-in-part of application No. 11/057,767, filed on Feb. 15, 2005.

(51) Int. Cl.
*A43B 5/16* (2006.01)

(52) U.S. Cl. ..... 36/115; 36/88

(58) Field of Classification Search ..... 36/115, 36/88, 117.1, 72 R
See application file for complete search history.

(56) References Cited

U.S. PATENT DOCUMENTS 3,235,978 A * 2/1966 Hyde ..... 36/115
3,537,716 A * 11/1970 Norgiel ..... 280/11.3
3,659,361 A * 5/1972 White, Sr. ..... 36/89
3,729,841 A * 5/1973 Wagner ..... 36/118.8
4,835,885 A * 6/1989 Hoshizaki et al. ..... 36/115
6,079,128 A * 6/2000 Hoshizaki et al. ..... 36/89
6,102,881 A * 8/2000 Quackenbush et al. ..... 602/28
6,135,464 A * 10/2000 Borel ..... 280/11.221
6,260,290 B1 * 7/2001 Chenevert ..... 36/115
6,499,233 B1 * 12/2002 Chenevert ..... 36/55
6,550,159 B1 * 4/2003 Madore ..... 36/115
6,769,203 B1 * 8/2004 Wright et al. ..... 36/115
6,871,424 B2 9/2005 Labonté et al.
2001/0042324 A1 * 11/2001 Filice ..... 36/115
2004/0016150 A1 * 1/2004 Labonte et al. ..... 36/115
2005/0126046 A1 * 6/2005 Labonte et al. ..... 36/115
2005/0193594 A1 * 9/2005 Murphy ..... 36/89
2005/0210709 A1 * 9/2005 Labonte ..... 36/89
2005/0229436 A1 * 10/2005 Bock ..... 36/115

FOREIGN PATENT DOCUMENTS

DE 195 23 224 A1 1/1997

* cited by examiner

*Primary Examiner*—Marie Patterson

(57) ABSTRACT

A skate boot for enclosing a human foot when in use, the foot having a heel, an ankle with a medial malleolus and a lateral malleolus, an Achilles tendon having an upper part and a lower part that projects outwardly with relation to the upper part, the lower part merging with the heel, a plantar surface, medial and lateral sides and toes. The skate boot comprises an outer shell and a tendon guard affixed to the outer shell. The tendon guard is more flexible than the outer shell such that it allows backwards flexion of the ankle when the foot moves towards full extension.

22 Claims, 12 Drawing Sheets

SKATE BOOT

The present application is a continuation-in-part of U.S. patent application Ser. No. 11/057,766 to Labonté and U.S. patent application Ser. No. 11/057,767 to Labonté, both filed on Feb. 15, 2005.

FIELD OF THE INVENTION

The present invention relates to a skate boot comprising an outer shell having a flexible tendon guard.

BACKGROUND OF THE INVENTION

U.S. Pat. No. 6,260,290 discloses a skate boot comprising quarter medial and lateral portions integrally connected together in a one-piece construction and being folded at a symmetry line to form a U-shaped skate boot structure. The skate boot has a tendon guard secured to the quarter medial and lateral portions at a junction line in a side-by-side fashion thereby resulting in the rear portion of the skate boot having an obtuse angular profile defined by the tendon guard and the quarter medial and lateral portions.

U.S. Pat. No. 6,550,159 discloses a skate boot comprising an articulated cuff for encircling and supporting the ankle of a skater. The articulated cuff is partially inserted in the skate boot and is slidably coupled to the skate boot to permit forward and backward motion of the articulated cuff relative to an axis coinciding approximately with the pivot axis of the ankle of the skater.

The most recent trend in skate boot construction is to manufacture skate boots using lightweight components, and where possible with a reduced number of components.

Accordingly, there is a need in the industry for a lighter skate boot that provides rigidity Accordingly, there is a need in the industry for a lighter skate boot that provides rigidity around the ankle while allowing backwards flexion of the ankle when the foot of the skater moves towards full extension.

SUMMARY OF THE INVENTION

As embodied and broadly described herein, the invention provides a skate boot for enclosing a human foot when in use, the foot having a heel, an ankle with a medial malleolus and a lateral malleolus, an Achilles tendon having an upper part and a lower part that projects outwardly with relation to the upper part, the lower part merging with the heel, a plantar surface, medial and lateral sides and toes. The skate boot comprises (a) an outer shell comprising a heel portion for receiving the heel of the foot; an ankle portion for receiving the ankle, the ankle portion comprising a rear portion for facing at least partially the lower part of the Achilles tendon; and medial and lateral side portions for facing the medial and lateral sides of the foot respectively; and (b) a tendon guard affixed to the ankle portion for facing at least partially the upper part of the Achilles tendon, the tendon guard being more flexible than the outer shell such that the tendon guard allows backwards flexion of the ankle when the foot moves towards full extension.

The invention also provides a skate boot for enclosing a human foot when in use, the foot having a heel, an ankle with a medial malleolus and a lateral malleolus, an Achilles tendon having an upper part and a lower part that projects outwardly with relation to the upper part, the lower part merging with the heel, a plantar surface, medial and lateral sides and toes. The skate boot comprises (a) an outer shell comprising a heel portion for receiving the heel of the foot; an ankle portion for receiving the ankle, the ankle portion comprising a rear portion for facing at least partially the lower part of the Achilles tendon; and medial and lateral side portions for facing the medial and lateral sides of the foot respectively; and (b) a tendon guard comprising a bottom portion affixed to the ankle portion and a flexing portion projecting upwardly from the bottom portion for facing at least partially the upper part of the Achilles tendon, the flexing portion being more flexible than the outer shell such that the flexing portion is capable of flexing rearwardly for allowing backwards flexion of the ankle when the foot moves towards full extension.

The invention further provides a skate boot for enclosing a human foot when in use, the foot having a heel, an ankle with a medial malleolus and a lateral malleolus, an Achilles tendon having an upper part and a lower part that projects outwardly with relation to the upper part, the lower part merging with the heel, a plantar surface, medial and lateral sides and toes. The skate boot comprises (a) an outer shell made of thermoformable material, the outer shell being thermoformed such that it comprises a heel portion for receiving the heel of the foot; an ankle portion for receiving the ankle and having a rear portion for facing at least partially the lower part of the Achilles tendon; and medial and lateral side portions for facing the medial and lateral sides of the foot respectively; and (b) a tendon guard affixed to the ankle portion for facing at least partially the upper part of the Achilles tendon, the tendon guard being made of a flexible material such that the tendon guard allows backwards flexion of the ankle when the foot moves towards full extension, the flexible material being made by injecting molding.

Moreover, the invention provides a skate boot for enclosing a human foot when in use, the foot having a heel, an ankle with a medial malleolus and a lateral malleolus, an Achilles tendon having an upper part and a lower part that projects outwardly with relation to the upper part, the lower part merging with the heel, a plantar surface, medial and lateral sides and toes. The skate boot comprises (a) an outer shell comprising a heel portion for receiving the heel of the foot; an ankle portion for receiving the ankle and having a rear portion for facing at least partially the lower part of the Achilles tendon; and medial and lateral side portions for facing the medial and lateral sides of the foot respectively; and (b) a tendon guard for facing at least partially the upper part of the Achilles tendon, the tendon guard being made of a flexible material such that the tendon guard flexes rearwardly from an initial position when the foot moves towards full extension, said flexible material having enough resiliency such that the tendon guard returns to its initial position when pressure is no longer applied on it.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of examples of embodiments of the present invention is provided hereinbelow with reference to the following drawings, in which.

Figure 1:
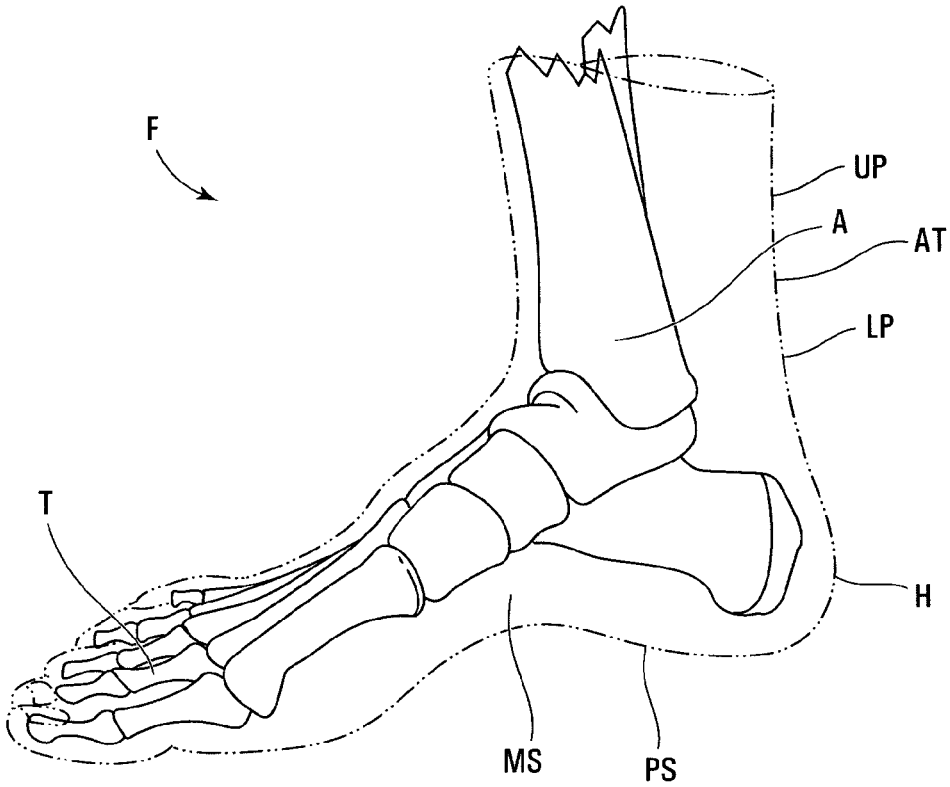
FIG. 1 is a side view of a right human foot with the integument of the foot shown in stippled lines and the bones shown in solid lines.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Figure 2:
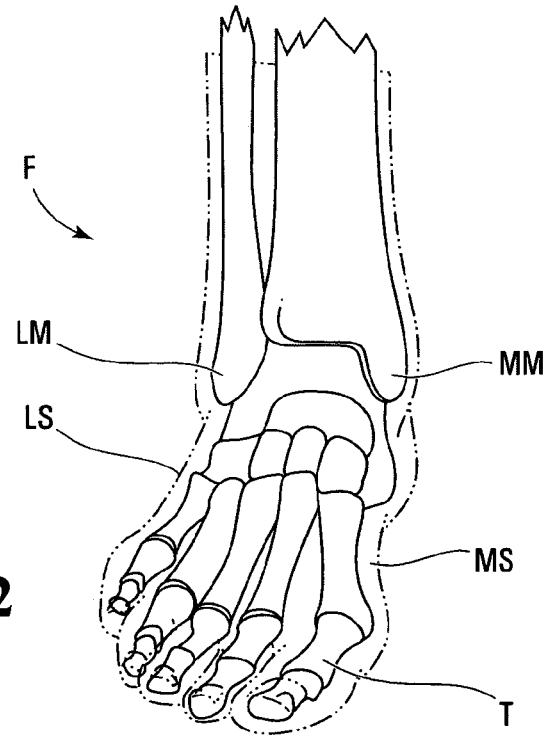
FIG. 2 is a front view of the human foot of FIG. 1.

Shown in FIGS. 1 and 2 is a typical right human foot F that includes toes T, a plantar surface PS, a medial side MS and a lateral side LS. In addition, the human foot includes a heel H, an Achilles tendon AT and an ankle A having a lateral malleolus LM and a medial malleolus MM, the lateral malleolus LM being at a lower position than the medial malleolus MM. The Achilles tendon AT has an upper part UP and a lower part LP projecting outwardly with relation to the upper part UP, the lower part merging with the heel H.

Figure 3:
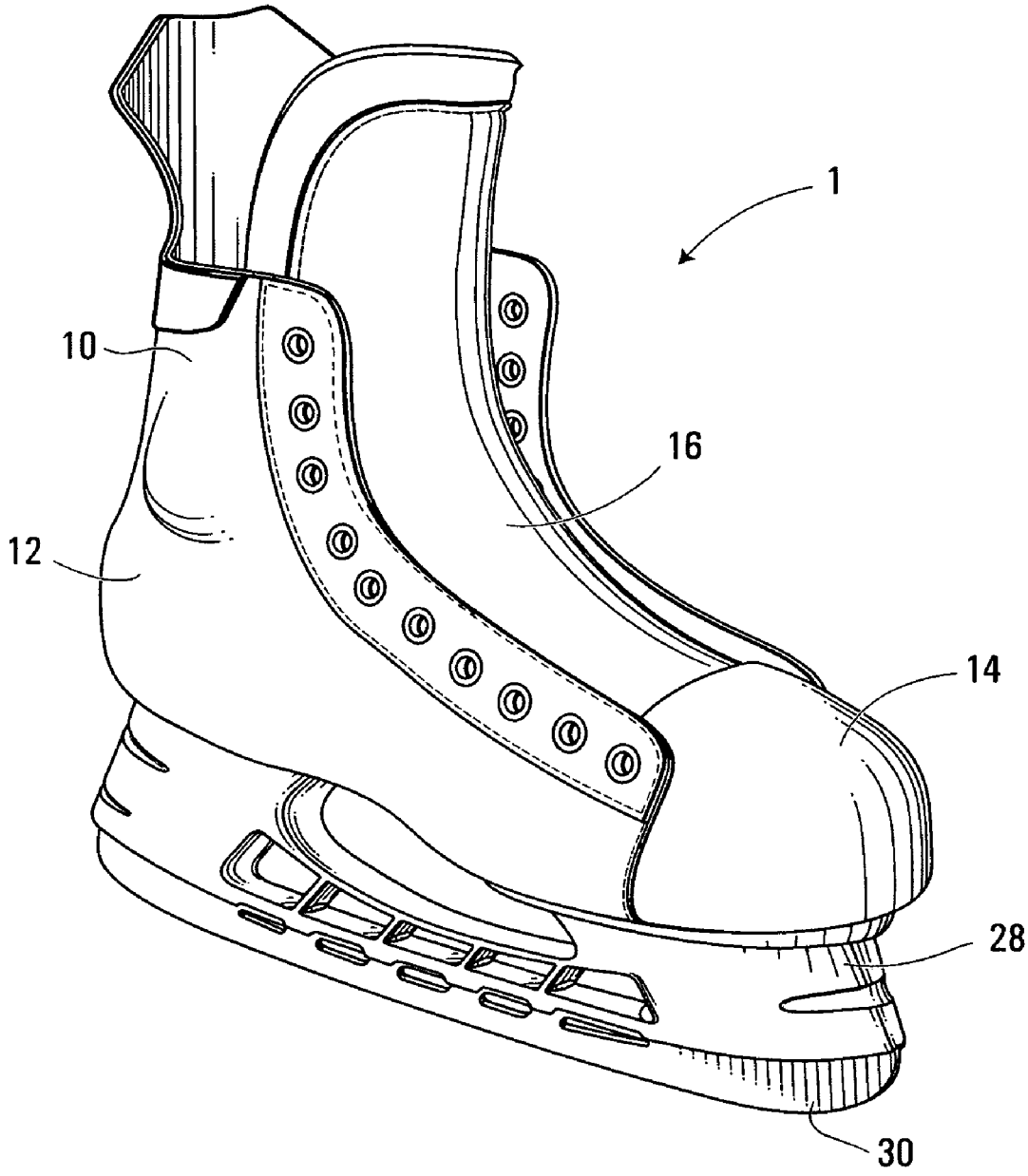
FIG. 3 is a perspective view of an ice skate in accordance with the present invention.
Figure 4:
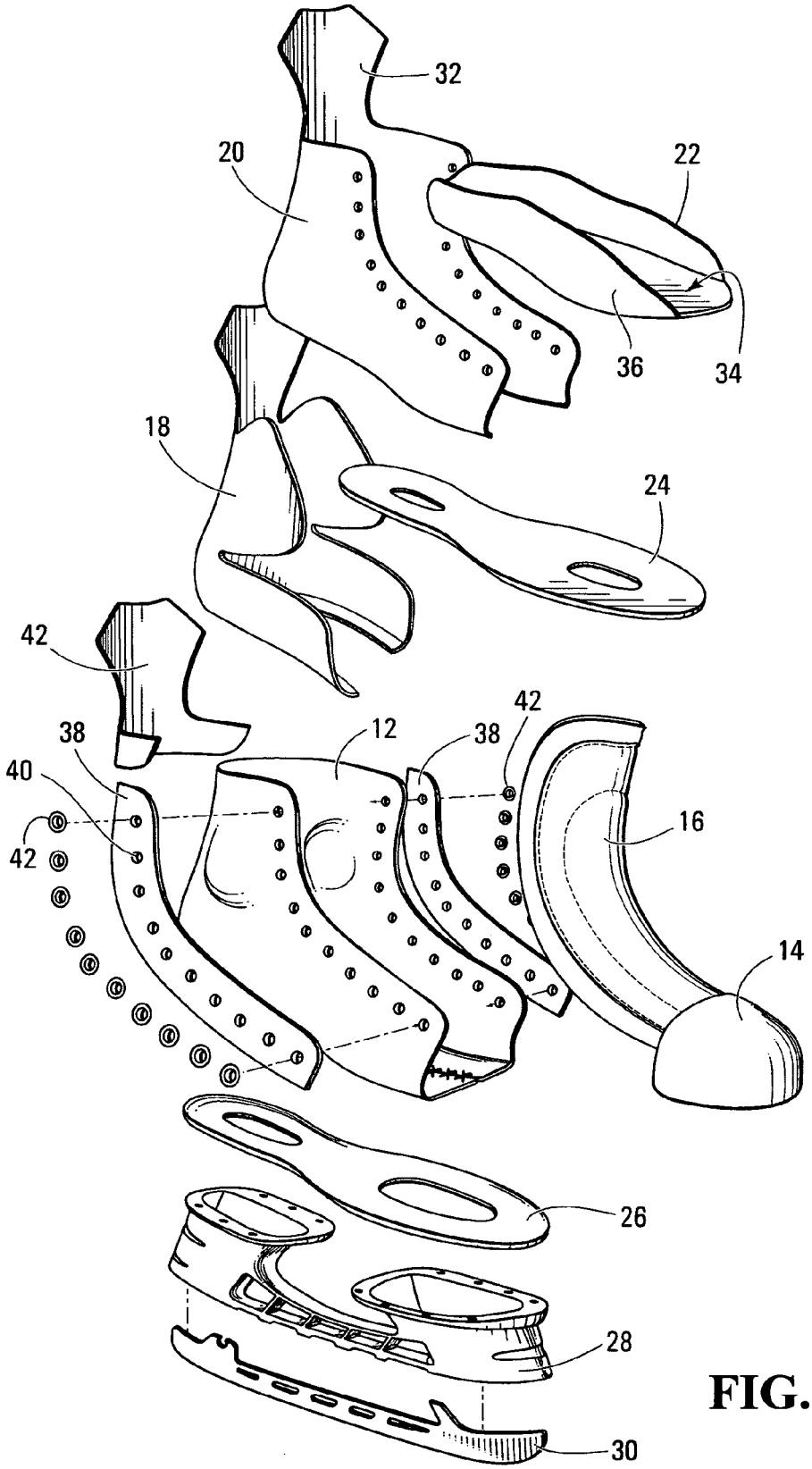
FIG. 4 is an exploded view of the ice skate of FIG. 3.
Figure 5:
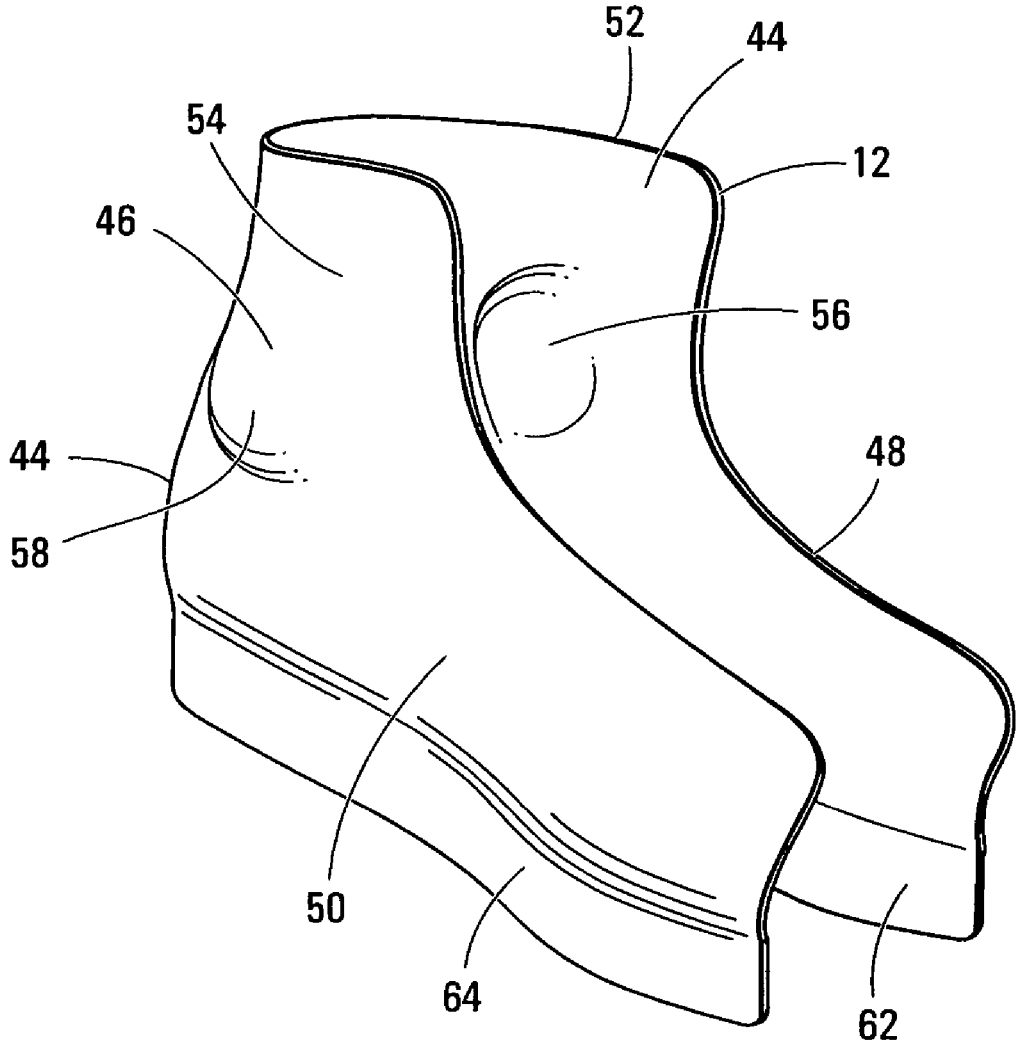
FIG. 5 is a perspective view of the outer shell of FIGS. 3 and 4, wherein the outer shell is in a partial state of completion.

Shown in FIGS. 3 and 4 is an ice skate 1 that comprises a skate boot 10 suitable for enclosing the foot F. Although the skate boot 10 shown in the figures is being used for an ice skate 1, it is understood that the skate boot 10 can be used for a roller skate.

The ice skate 1 has an outer shell 12 for receiving the foot F, a toe cap 14 made of rigid molded plastic for facing the toes T, a tongue 16 extending upwardly and rearwardly from the toe cap 14 for covering the forefoot of the foot F, a rigid insert 18 for providing more rigidity around the ankle A and heel H, an inner lining 20, a footbed 22, an insole 24, an outsole 26, an ice skate blade holder 28 and a blade 30. The rigid insert 18 may be glued to an inner surface of the outer shell 12. It is understood that the rigid insert 18 is an optional component and may be eliminated if the outer shell 12 is sufficiently rigid for supporting the ankle A and heel H. Similarly, the insole 24 and outsole 26 are optional components and may be eliminated if the outer shell 12 is sufficiently rigid for receiving the blade holder 28.

The inner lining 20 is affixed to an inner surface of the outer shell 12 and it comprises an inner surface 32 intended for contact with the heel H, ankle A and medial and lateral sides MS, LS of the foot F in use. If the skate boot 10 comprises the rigid insert 18, such rigid insert 18 is sandwiched between the outer shell 12 and inner lining 20 and such inner lining 20 may be glued to the inner surfaces of the outer shell 12 and rigid insert 18 and stitched along its periphery to the outer shell 12. The inner lining 20 is made of a soft material and can be a fabric made of 100% NYLON® fibers. The footbed 22 is mounted inside the outer shell 12 and it comprises an upper surface 34 for receiving the plantar surface PS and a wall 36 projecting upwardly from the upper surface 34. The wall 36 partially cups the heel H and extends up to a medial line of the foot F.

The skate boot 10 also comprises bands 38 secured to upper side portions of the outer shell 12. The bands 38 may be made of fabric, textile or leather and comprises apertures 40. Eyelets 42 are punched into the band 38, outer shell 12 and inner lining 20 vis-à-vis apertures 40. The skate boot 10 further comprises a tendon guard 42 for facing at least partially the upper part UP of the Achilles tendon AT.

The outer shell 12 will now be described in more detail below with respect to FIGS. 5 to 8. While the tendon guard 42 is made of a flexible material, the outer shell 12 is made of a more rigid material in order to provide enough support to the foot F. The outer shell 12 may be made of a thermoformable material. As used herein, the expression "thermoformable material" refers to a material that is capable of softening when heated and of hardening again when cooled. Some non-limiting examples of different types of thermoformable material comprise ethylene vinyl acetate (EVA) foam, polyethylene foam, polystyrene foam, polypropylene foam and thermoformable materials sold under the trade-marks MEGABIX®, SURLYN®, SONTARA®, FORMO500®, BYLON®, MOSOCA® and NYLON® 66.

The outer shell 12 may be made from a pre-cut sheet of thermoformable material having a profile corresponding to that of the outer shell 12. The sheet of material may be a composite sheet having a layer of thermoformable foam. Some non-limiting examples of different types of thermoformable foam include ethylene vinyl acetate (EVA) foam, polyethylene foam and polypropylene foam. High density polyethylene (HDPE) 1300, 1100 and 0907 foams can also be used. The sheet may be made of thermoforming materials such as those sold under the trade-mark MEGABIX® (a core of extruded SURLYN®, a backing of SONTARA® and a hot melt coating; thickness of 0.95 mm), FORMO500® (non woven polyester with a core of extruded polyolefinic, stiffening layers of synthetic latex on each side and an ethylene vinyl acetate hot melt adhesive on one side; thickness of 1.50 mm), BYLON® (a nylon multifilament with a backing of black saturated needle punched polyester nonwoven and a face coating of non-fray urethane) and MOSOCA® (NYLON® 66 with a core of SURLYN® and a PU coating). The composite sheet may also be made of a first sheet of polyethylene high density (HDPE) foam; a second sheet of thermoplastic; and a third composite sheet made of a first layer of cotton, a second layer of SURLYN® fibers, a third layer of a mesh of NYLON® fibers and a coating. These sheets being laminated together before or during the thermoforming process of the outer shell 12.

The sheet of thermoformable material may include two or three layers, wherein the layer that will form the outer surface of the outer shell 12 is more rigid that the layer that will form the inner surface of the outer shell 12. A layer of thermoformable foam may be located between the inner and outer layers. In a non-limiting embodiment, the thermoformed shell 12 is made of a single sheet made of thermoformable material. However, it should be understood that the thermoformed shell could also be made of multiple sections. For example, the thermoformed shell could be made from separate medial and lateral side portions that are affixed together.

The outer shell 12 is thermoformed such that it comprises a heel portion 44 for receiving the heel H, an ankle portion 46 for receiving the ankle A and medial and lateral side portions 48, 50 for facing the medial and lateral sides MS, LS respectively. These components form a foot receiving cavity that conforms to the general shape of the foot F.

The heel portion 44 may be thermoformed such that it is substantially cup shaped for following the contour of the heel H.

The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM. The lateral depression 58 is located slightly lower than the medial depression 56, for conforming to the morphology of the foot F. The ankle portion 46 further comprises a rear portion 60 facing the lower part LP of the Achilles tendon AT. The rear portion 60 may be thermoformed such that it follows the lower part LP of the Achilles tendon AT.

Figure 6:
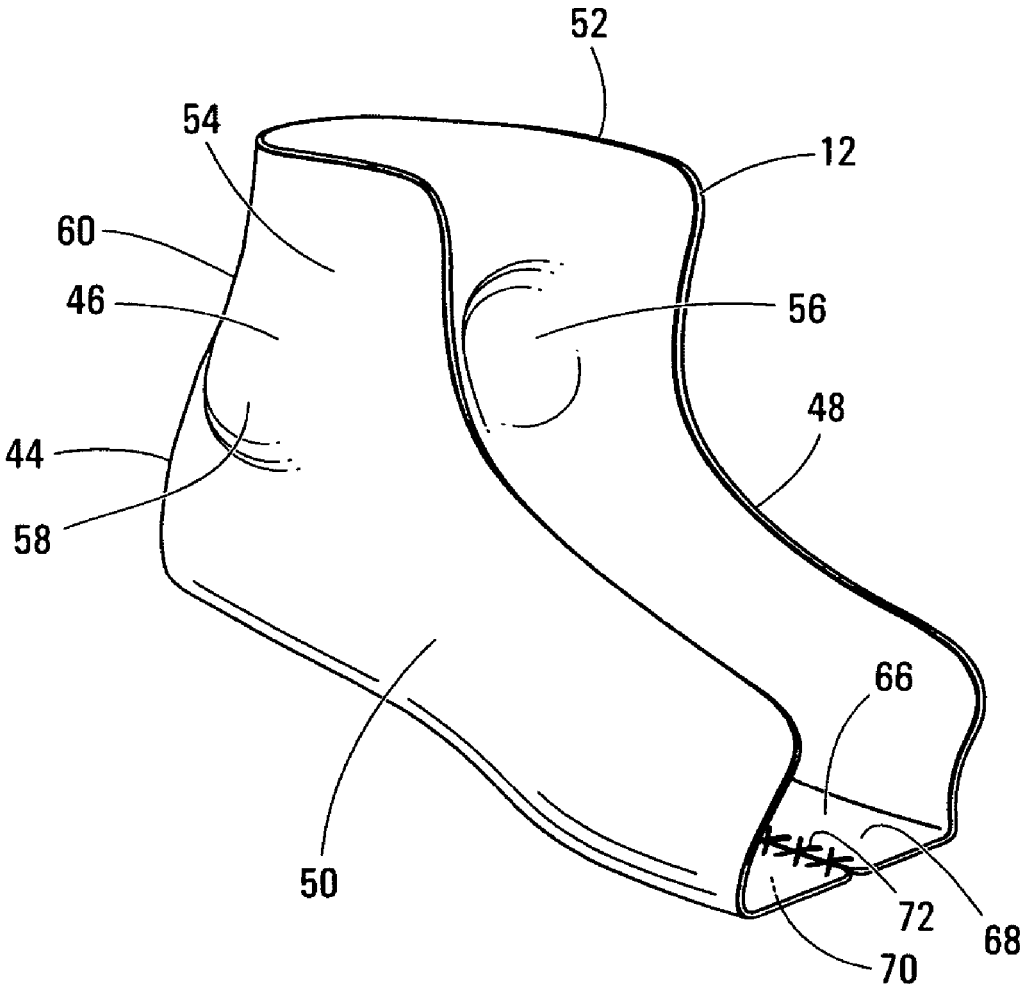
FIG. 6 is a perspective view of the outer shell of FIGS. 3 and 4.

The medial and lateral side portions 48, 50 extend forwardly from the heel and ankle portions 44, 46 and comprise respective medial and lateral skirt portions 62, 64 that are integrally formed therewith and extend downwardly therefrom. As shown in FIG. 6, in order to complete the outer shell 12, the medial and lateral skirt portions 62, 64 are folded inwardly to form a sole 66 having an upper surface 68 for facing a substantial portion of the plantar surface PS and a bottom surface 70 for receiving an outsole, a blade holder or a roller chassis. The medial and lateral skirt portions 62, 64 may be affixed together via stitching 72. It should however be understood that the skirt portions 62, 64 could be affixed together in a variety of different manners without departing from the spirit of the invention.

As shown in FIG. 4, the skate boot 10 may comprises the insole 24 that has an upper surface for facing the plantar surface PS of the foot and a bottom surface on which the upper surface 68 of the sole 66 may be affixed. The boot 10 may also comprise the outsole 26 that has a bottom surface of which the blade holder 28 is mounted. It is however understood that the insole 24 and outsole 26 are optional components and may be eliminated if the sole is sufficiently rigid for receiving the blade holder 28. Alternatively, only the outsole 26 may be eliminated and the insole 24 may still be used in the construction of the skate boot 10.

Figure 7:
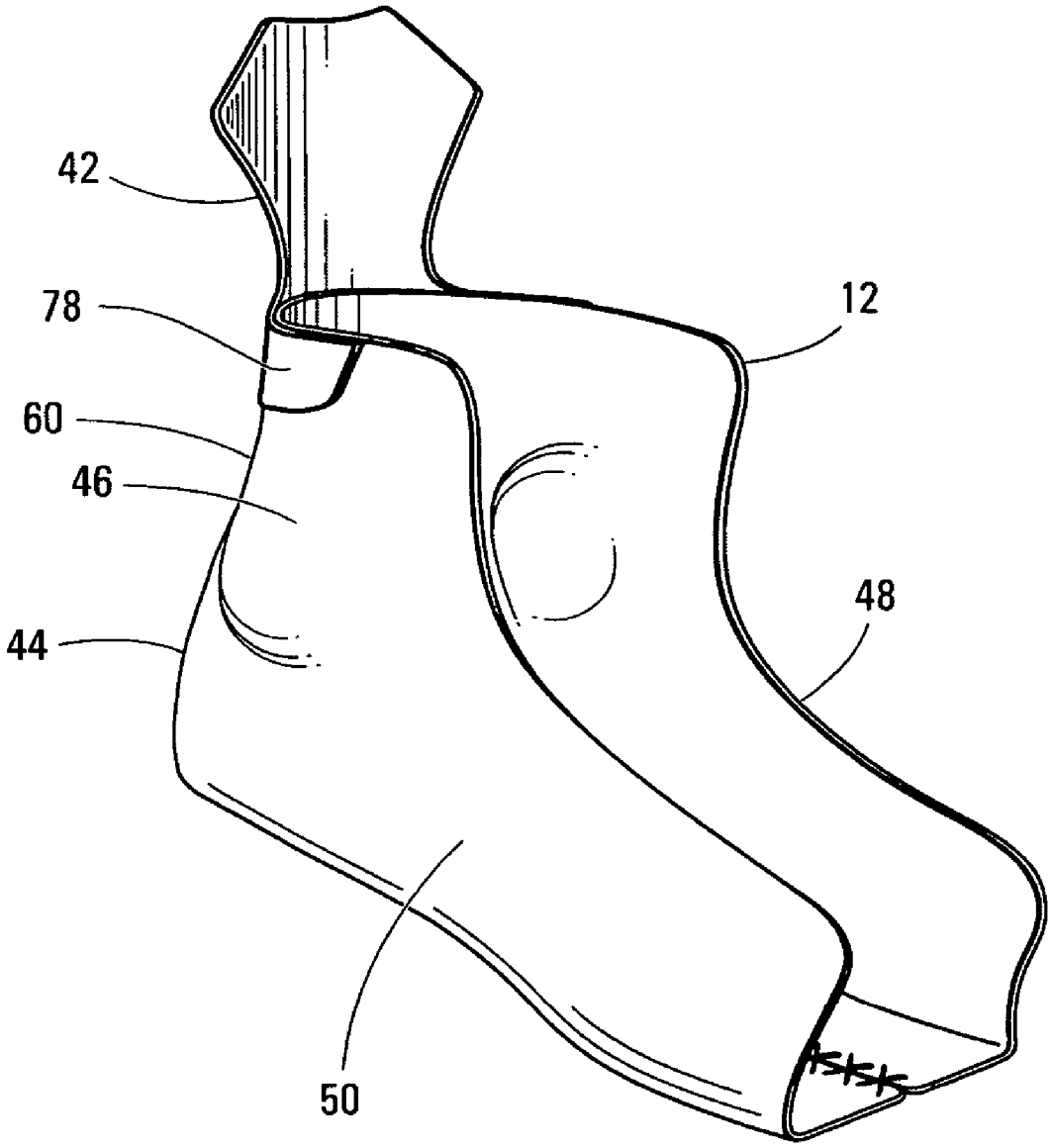
FIG. 7 is a perspective view of the outer shell of FIGS. 3 and 4 with the tendon guard of FIGS. 3 and 4.
Figure 8:
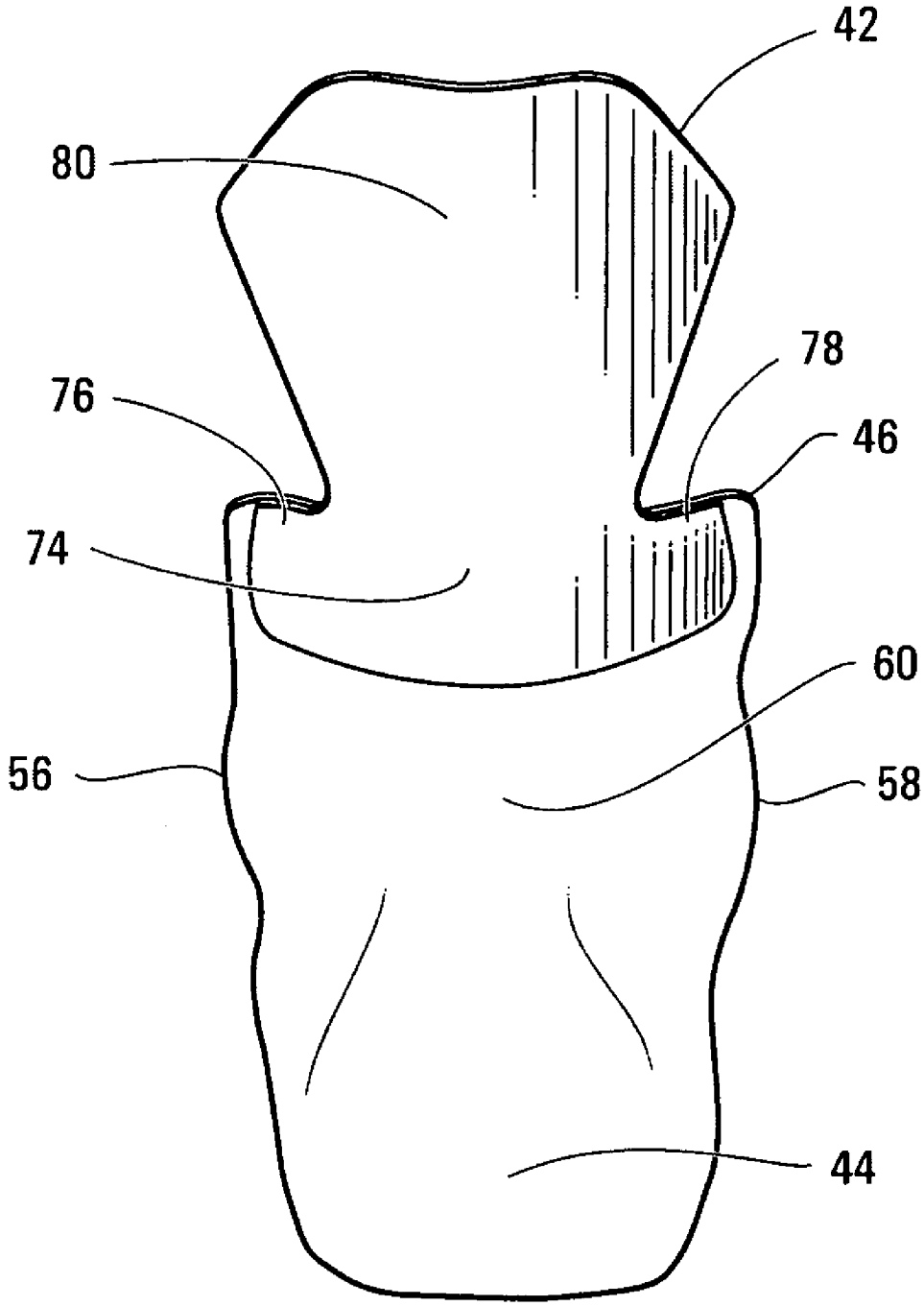
FIG. 8 is a rear elevational view of the outer shell and tendon guard of FIG. 7.

Referring to FIGS. 7 and 8, the tendon guard 42 is affixed to the ankle portion 46 of the outer shell 12 for facing at least partially the upper part UP of the Achilles tendon AT. The tendon guard 42 can be affixed to the ankle portion 46 via stitching, over molding, thermal bonding, high frequency welding, vibration welding, piping, zipper, adhesive and staples, among other possibilities known in the art. The tendon guard 42 is more flexible than the outer shell 12 such that it allows backwards flexion of the ankle A when the foot F moves towards full extension. The tendon guard 42 may be made of silicone or may be made by injection molding using polyester (e.g. polyester HYTREL®) polyurethane, polyamide, or other suitable thermoplastics. The selected material must have enough flexibility for allowing the tendon guard to flex rearwardly when pressure is applied on it while it should also have enough resiliency for allowing the tendon guard to return to its initial position when pressure is no longer applied on the tendon guard.

The tendon 42 may comprise a bottom portion 74 and a flexing portion 80 that projects upwardly from the bottom portion 74 for facing at least partially the upper part UP of the Achilles tendon AT. The bottom portion 74 of the tendon guard 42 is affixed to the rear portion 60 of the ankle portion 46. The tendon guard 42 may also comprise medial and lateral side portions 76, 78 extending forwardly from the bottom portion 74 and being affixed to the respective medial and lateral ankle sides 52, 54 of the ankle portion 46.

The skate boot 10 may comprise a single continuous band that covers the upper portion of each of the medial and lateral side portions 48, 50 of the outer shell 12 and wraps around the rear portion 60 and sides 52, 54 of the ankle portion 46 and cover the bottom, medial and lateral side portions 74, 76, 78 of the tendon guard 42 instead of the two distinct bands 38 shown in FIGS. 3 and 4. The single continuous band is made of fabric, textile or leather. In such an alternative embodiment, the portions 74, 76, 78 of the tendon guard 42 is sandwiched between the single continuous band and the outer shell 12. The skate boot 10 may also comprise an overlay covering a rear part of the flexing portion 80 of the tendon guard 42, such overlay being made of fabric, textile or leather. In such further alternative embodiment, the flexing portion 80 is sandwiched between the overlay and the inner lining 20.

Figure 9:
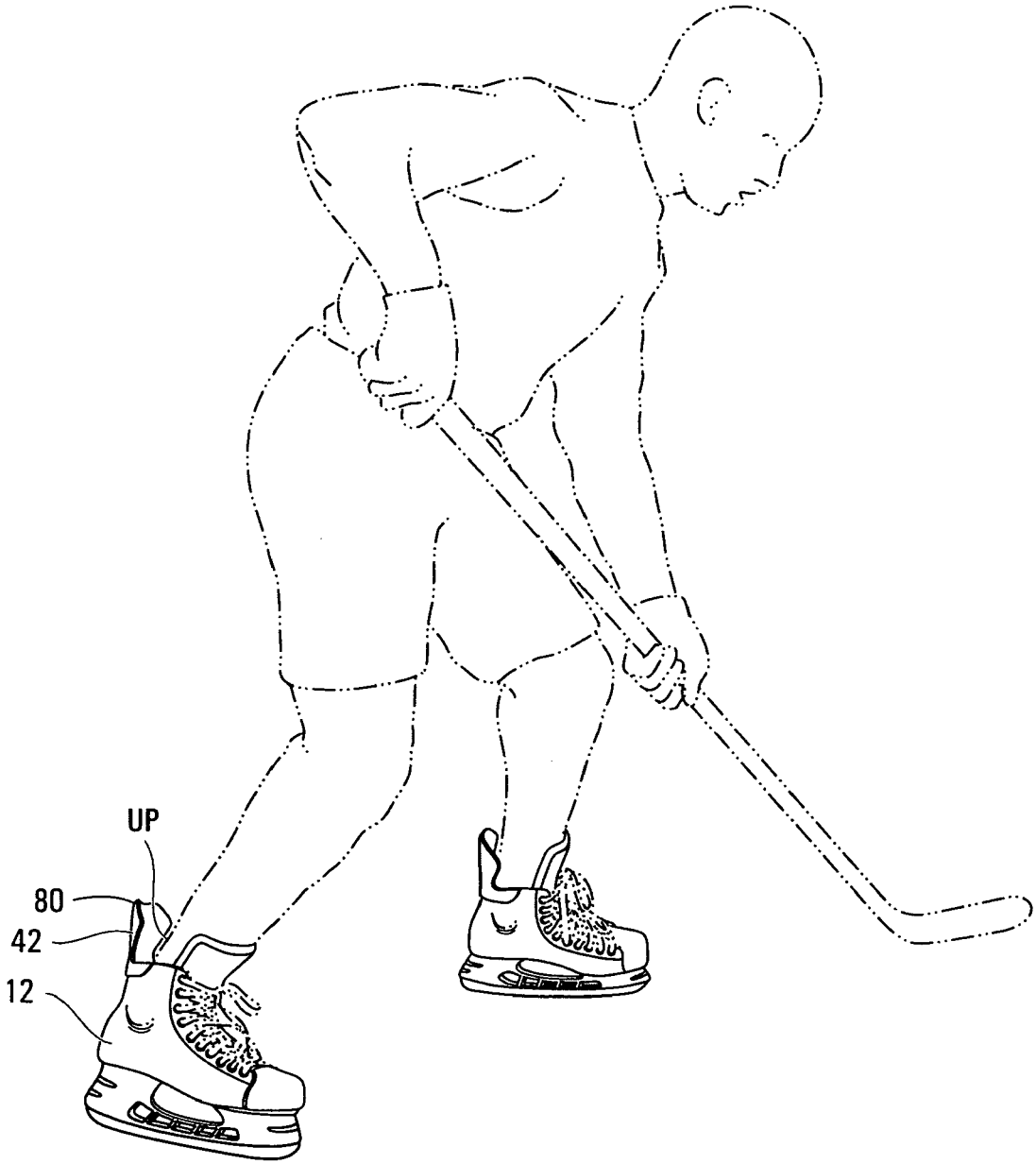
FIG. 9 shows a skater in a first skating position.
Figure 10:
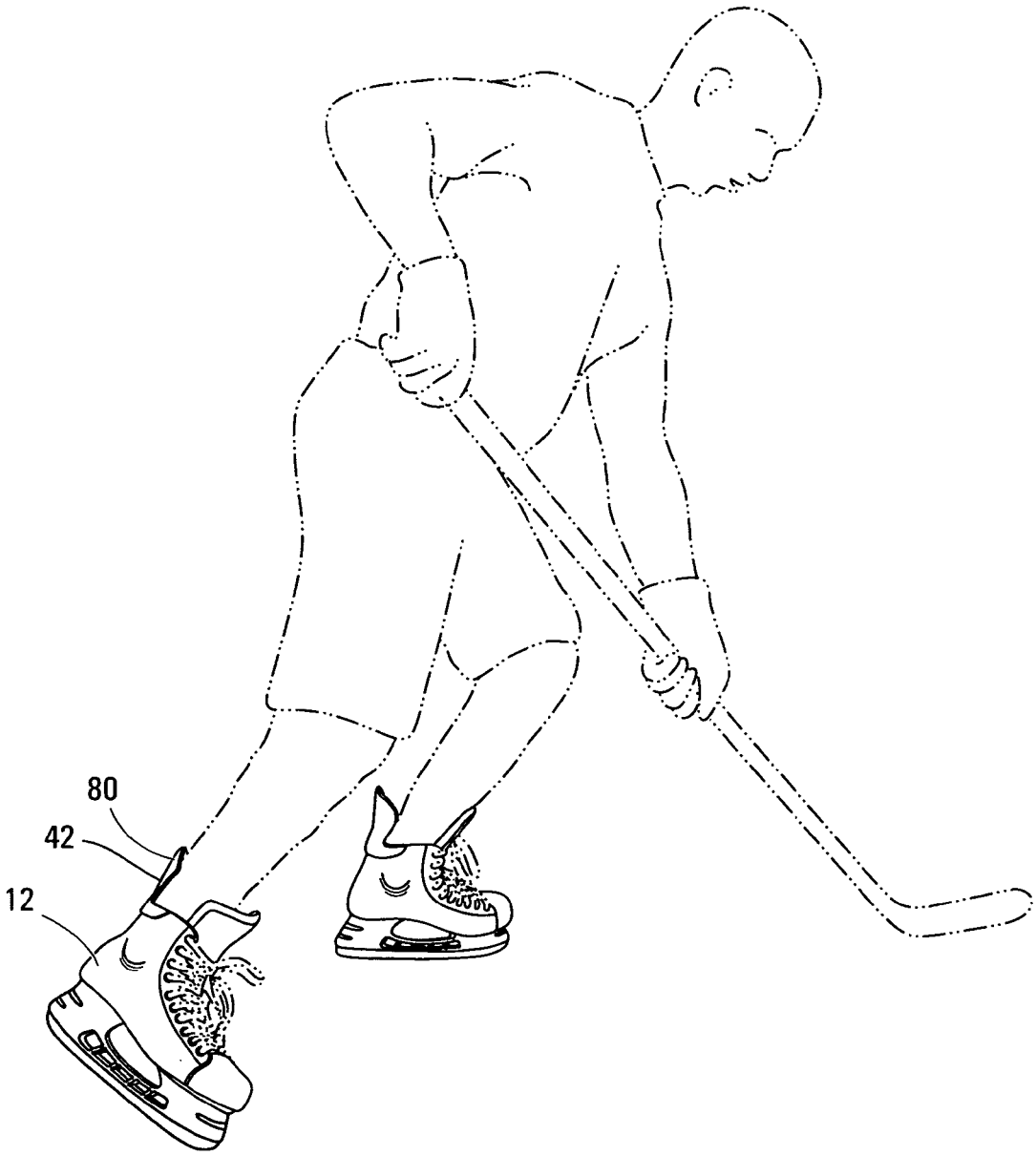
FIG. 10 shows the skater in a second skating position.
Figure 11:
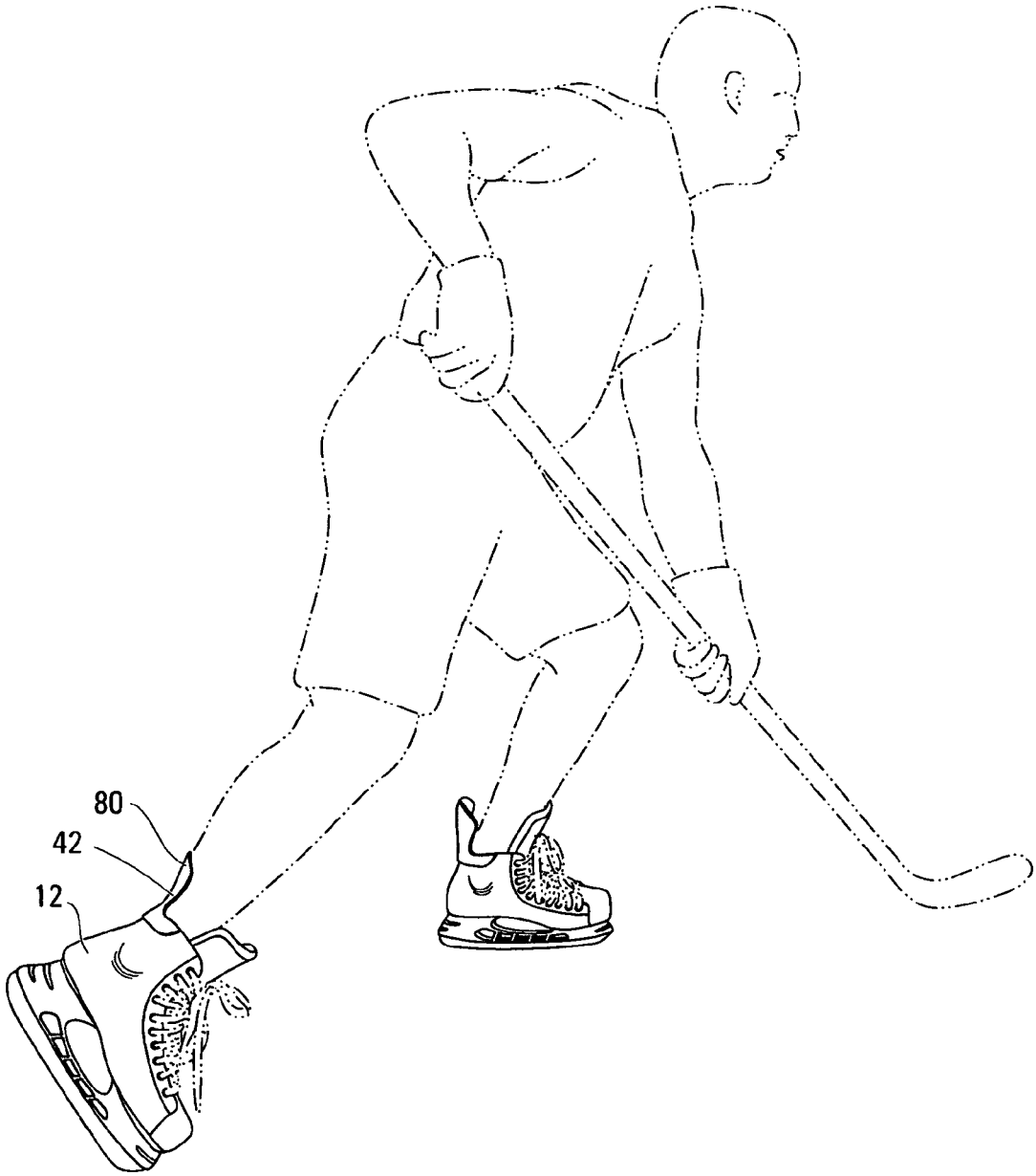
FIG. 11 shows the skater in a third skating position.
Figure 12:
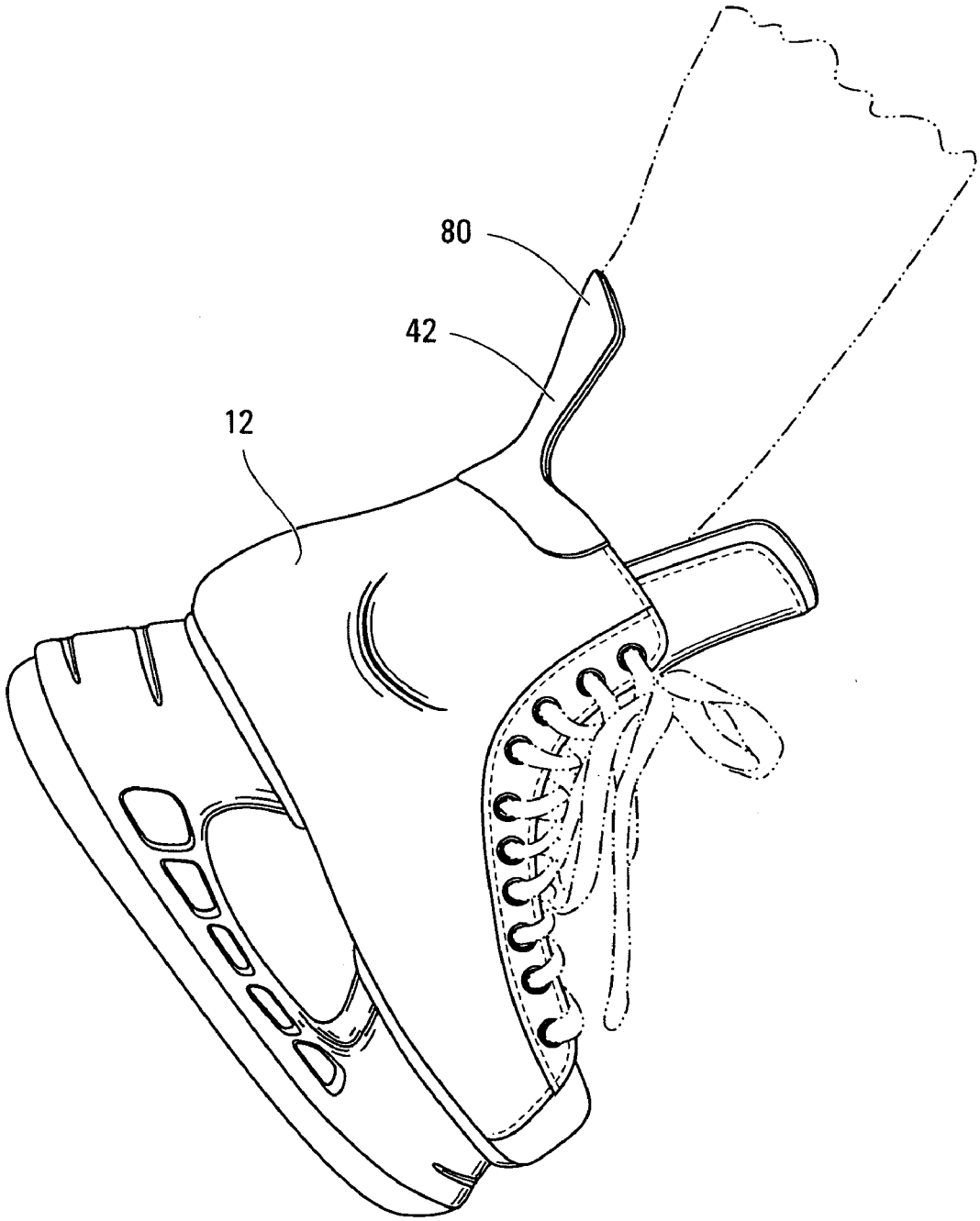
FIG. 12 is an enlarged view of the right skate of FIG. 11.

FIGS. 9 to 12 show a skater in different skating positions. In FIG. 9, the right foot of the skater begins the pushing action against the ice. As shown in this figure, the flexing portion 80 of the tendon guard 42 faces at least partially the upper part UP of the Achilles tendon AT but does not contact the upper part UP. In FIG. 10, the right foot of the skater continues its pushing action and the flexing portion 80 of the tendon guard 42 then abuts against the upper part UP of the Achilles tendon AT. As shown in FIGS. 11 and 12, when the right foot of the skater continues its pushing action and reaches full extension, the flexing portion 80 allows backwards flexion of the ankle A. Hence, because of its flexibility, the tendon guard 42 allows backwards flexion of the ankle A when the foot of the skater moves towards full extension. Note that only the foremost part of the blade contacts the ice when the skater reaches full push extension.

After reaching full push extension, the foot of the skater moves forwardly without touching the ice and another pushing motion of the foot will begin once the skate will again touch the ice. It is understood that the tendon guard 42 should return to its initial position shown in FIG. 9 once the full push extension of the foot is completed. In that sense, while the material of the tendon guard 42 is enough flexible for allowing the tendon guard 42 to flex rearwardly from its initial position when the foot of the skater moves towards full extension, the material should also have enough resiliency such that the tendon guard 42 return to its initial position shown in FIG. 9 when no pressure is applied on it.

Figure 13:
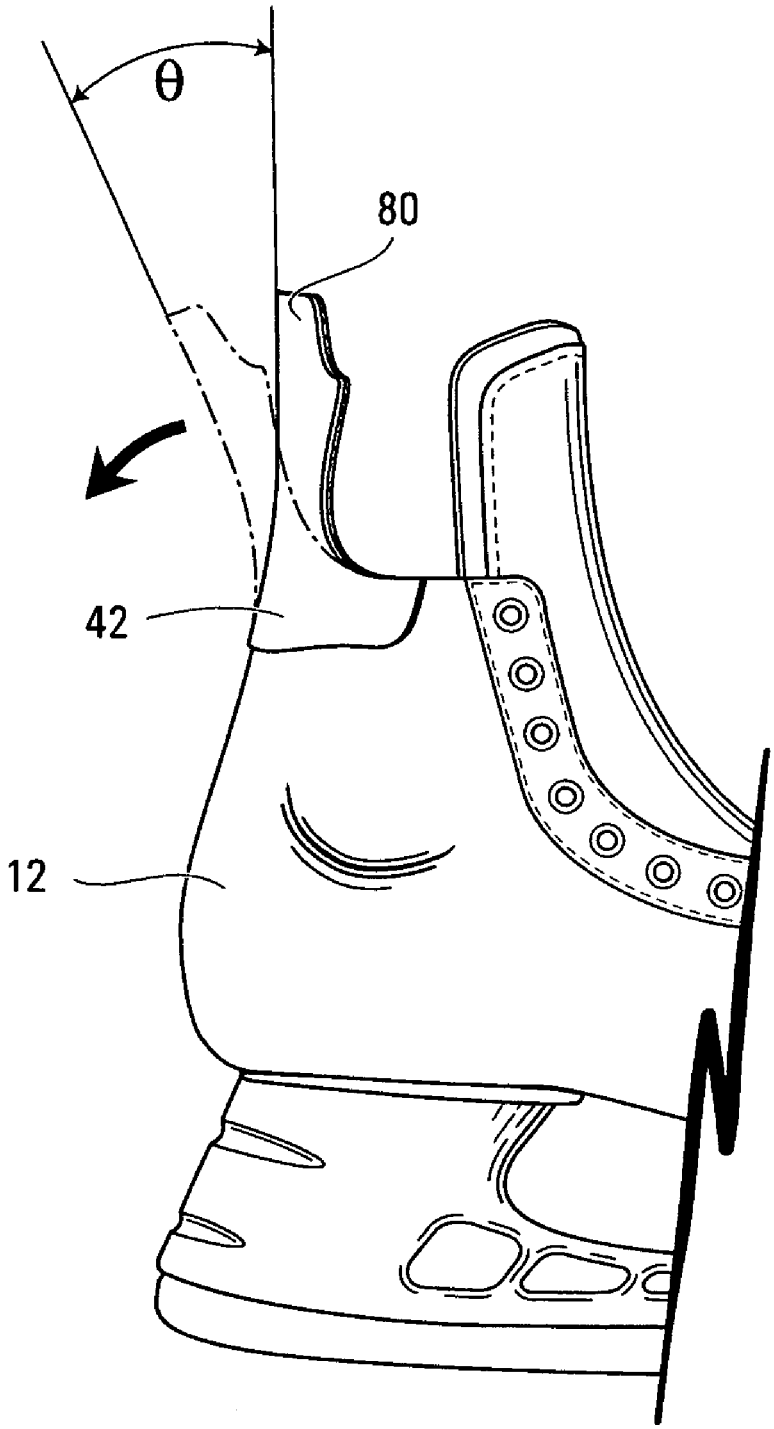
FIG. 13 is a partial side elevational view of the ice skate of FIG. 3 showing in stippled lines the tendon guard in a position wherein the tendon guard allows backwards flexion of the ankle of the skater.

As shown in FIG. 13, in its initial position shown in full lines, the tendon guard 42 is in a generally vertical position. When the ankle flexes backwards and pressure is applied against the flexing portion 80 of the tendon guard 42, the tendon guard 42, as shown in stippled lines, is then capable of flexing rearwardly of an angle θ, such angle θ may be up to 90°.

The above description of the embodiments should not be interpreted in a limiting manner since other variations, modifications and refinements are possible within the spirit and scope of the present invention. The scope of the invention is defined in the appended claims and their equivalents.

The invention claimed is:

1. A skate boot for enclosing a human foot when in use, the foot having a heel, an ankle with a medial malleolus and a lateral malleolus, an Achilles tendon having an upper part and a lower part that projects outwardly with relation to the upper part, the lower part merging with the heel, a plantar surface, medial and lateral sides and toes, said skate boot comprising:

(a) an outer shell comprising a heel portion for receiving the heel of the foot; an ankle portion for receiving the ankle, said ankle portion comprising a rear portion for facing at least partially the lower part of the Achilles tendon; and medial and lateral side portions for facing the medial and lateral sides of the foot respectively; and (b) a tendon guard being made of a material more flexible than that of said outer shell, said tendon guard comprising a bottom portion affixed to said rear portion of said ankle portion and a flexing portion projecting upwardly from said bottom portion for facing at least partially the upper part of the Achilles tendon, said flexing portion being capable, when pressure is applied on it, of flexing rearwardly from an initial position for allowing backward flexion of the ankle when the foot moves towards full extension and, when pressure is no longer applied on it, of returning to said initial position.

2. A skate boot as defined in claim 1, wherein said tendon guard has a layer made of silicone.

3. A skate boot as defined in claim 1 wherein said ankle portion comprises a lateral ankle side for facing the lateral malleolus and medial ankle side for facing the medial malleolus and said tendon guard comprises medial and lateral side portions extending forwardly from said bottom portion of said tendon guard and being affixed to said respective medial and lateral ankle sides of said ankle portion.

4. A skate boot as defined in claim 1, wherein said outer shell comprises a layer of thermoformable material and said outer shell is thermoformed such that said heel portion is substantially cup shaped for following the contour of the heel of the foot and said rear portion of said ankle portion is shaped for following the lower part of the Achilles tendon.

5. A skate boot as defined in claim 4, wherein said outer shell is thermoformed such that said ankle portion comprises a lateral ankle side with a cup-shaped lateral depression for receiving the lateral malleolus and a medial ankle side with a cup-shaped medial depression for receiving the medial malleolus.

6. A skate boot as defined in claim 5, wherein said cup-shaped lateral depression is below said cup-shaped medial depression.

7. A skate boot as defined in claim 6 further comprising an insole facing the plantar surface of the foot.

8. A skate boot as defined in claim 7, wherein said outer shell comprises a lower skirt portion foldable to overlap said insole.

9. A skate boot as defined in claim 8, further comprising an outsole affixed to a bottom surface of said insole.

10. A skate boot as defined in claim 4, wherein said outer shell comprises a medial skirt portion integrally formed with said medial side portion and a lateral skirt portion integrally formed with said lateral side portion, said medial and lateral skirt portions being folded inwardly to form a sole facing the plantar surface of the foot.

11. A skate boot as defined in claim 10, wherein said medial and lateral skirt portions are affixed together.

12. A skate boot as defined in claim 11 further comprising an outsole affixed to a bottom surface of said sole.

13. A skate boot as defined in claim 4, wherein said outer shell comprises an outer layer and an inner layer, said outer layer being more rigid than said inner layer.

14. A skate boot as defined in claim 13, wherein said layer of thermoformable material is an intermediate layer and said outer and inner layers are made of thermoformable material, said intermediate layer being between said outer and inner layers.

15. A skate boot as defined in claim 14, wherein said intermediate layer is made of thermoformable foam.

16. A skate boot as defined in claim 1, further comprising an inner lining affixed to an inner surface of said outer shell, said inner lining comprising an inner surface intended for contact with the heel, ankle and lateral and medial sides of the foot in use.

17. A skate boot as defined in claim 1, further comprising a footbed mounted inside said outer shell, said footbed comprising an upper surface for receiving the plantar surface of the foot and a wall projecting upwardly from said upper surface, said wall partially cupping the heel and extending up to a medial line of the foot.

18. An ice skate comprising a skate boot as defined in claim 1.

19. A roller skate comprising a skate boot as defined in claim 1.

20. A skate boot as defined in claim 1, wherein said bottom portion of said tendon guard is affixed to said rear portion of said outer shell via an affixing means selected from the group consisting of stitching, over molding, thermal bonding, high frequency welding, vibration welding and adhesive.

21. A skate boot as defined in claim 1, wherein said tendon guard is made of silicone.

22. A skate boot as defined in claim 1, wherein said tendon guard is made by injection molding using a material selected from the group consisting of polyester, polyurethane and polyamide.

* * * * *